United States Patent [19]

Owlett

[11] 4,041,421

[45] Aug. 9, 1977

[54] STABILIZED LOCKING MECHANISM FOR THREADED TUNING SCREWS IN WAVEGUIDES

[75] Inventor: David Donald Owlett, Belmont, Calif.

[73] Assignee: GTE Automatic Electric Laboratories Incorporated, Northlake, Ill.

[21] Appl. No.: 682,690

[22] Filed: May 3, 1976

[51] Int. Cl.[2] ..... H01P 1/20; H01P 7/06; H01P 1/28

[52] U.S. Cl. ..... 333/73 W; 333/97 R; 333/98 R

[58] Field of Search ..... 333/73 W, 73 C, 33, 333/98 R, 97 R, 95 R, 83 R

[56] References Cited

U.S. PATENT DOCUMENTS 2,527,146 10/1950 Mumford ..... 333/33

OTHER PUBLICATIONS

Laughner et al., "Handbook of Fastening and Joining of Metal Parts," McGraw Hill, New York, 1956; Title page and pp. 153-156, 558-559.

*Primary Examiner*—Archie R. Borchelt
*Assistant Examiner*—Marvin Nussbaum
*Attorney, Agent, or Firm*—Russell A. Cannon; Leonard R. Cool

[57] ABSTRACT

A threaded invar tuning screw extending through the threaded aperture of an invar bushing in the broad wall of a waveguide filter presents a capacitance inside the waveguide. This capacitance is varied by changing the depth of the screw in the waveguide in order to tune the filter. A brass locknut on the screw has a truncated, conically shaped bottom that mates with a similarly shaped countersunk hole on the bushing, the conical bottom, countersunk hole, and screw being coaxial. The mating surfaces on the nut and the countersunk hole reduce lateral movement of the screw during tuning and fixing of the position of the latter by tightening the locknut against the bushing.

4 Claims, 2 Drawing Figures

STABILIZED LOCKING MECHANISM FOR THREADED TUNING SCREWS IN WAVEGUIDES

BACKGROUND OF INVENTION

This invention relates to tuning mechanism for structures that support propagating electromagnetic waves and more particularly to a locking mechanism for fixing the axial position of a threaded tuning or matching screw in a wall of a waveguide.

Various microwave devices including waveguide filters employ a metallic tuning screw in the wall of a waveguide. In the case of a filter, they are used to adjust the operating frequency of the filter. Such devices generally include a threaded bushing that is soldered into a broad wall, for example of the waveguide. The surface of the bushing in the waveguide is normally flush with the inner wall of the latter. A metallic tuning screw is threaded into the opening in the bushing so as to protrude into the waveguide. A conventional locknut is threaded onto the portion of the tuning screw on the outside of the waveguide with opposite faces of the nut being parallel to an adjacent surface on the bushing. At microwave frequencies, the portion of the screw in the waveguide operates as a capacitance. This capacitance is varied by rotating the screw to change the axial length thereof in the waveguide. When the screw is in the desired axial position in the waveguide, the locknut is tightened against the bushing to hold the screw in place. This tuning screw and locknut structure has the disadvantage that the screw may move sideways during tightening of the locknut and thereby detune the filter. If the locknut is partially tightened in order to minimize lateral movement of the screw, further rotation of the latter is rendered difficult. Also, since the mating surfaces of the locknut and the bushing are normal to the axis of the screw, considerable torque is required to ensure that the screw is locked in place. This may cause residual stresses in the threaded junctions that are relaxed with time and temperature cycling so as to produce slight movement of the screw which, in turn, detunes the filter. Although spring-loaded tuning screws provide axial tension during rotation of the screw, the spring also provides the locking action. Such a structure has no firm lateral support and is particularly sensitive to movement of the tuning screw from shock and vibration since it does not employ a locking nut. Tuning screws having precision threads are also available, but they are expensive.

SUMMARY OF INVENTION

An object of this invention is the provision of an improved locking mechanism for threaded tuning screws and the like.

In accordance with this invention, the mating surfaces of a locknut on a threaded screw and a threaded bushing in a waveguide wall both have conical faces such that they fit together. One mating surface is that of a truncated conical projection that is coaxial with the screw, whereas the other mating surface is that of a countersunk hole that is also coaxial with the screw and which receives the truncated conical projection.

DESCRIPTION OF PREFERRED EMBODIMENTS

Waveguide filters are well known and generally comprise several waveguide cavity sections connected in tandem. Each section has prescribed cross-sectional dimensions for supporting propagating electromagnetic waves of particular frequencies, has input and output coupling devices comprising electrically conductive posts extending between opposite walls of the waveguide; and one or more capacitive screws in waveguide walls. The depths of the screws in the waveguide are adjustable for tuning the waveguide filter.

Figure 1:
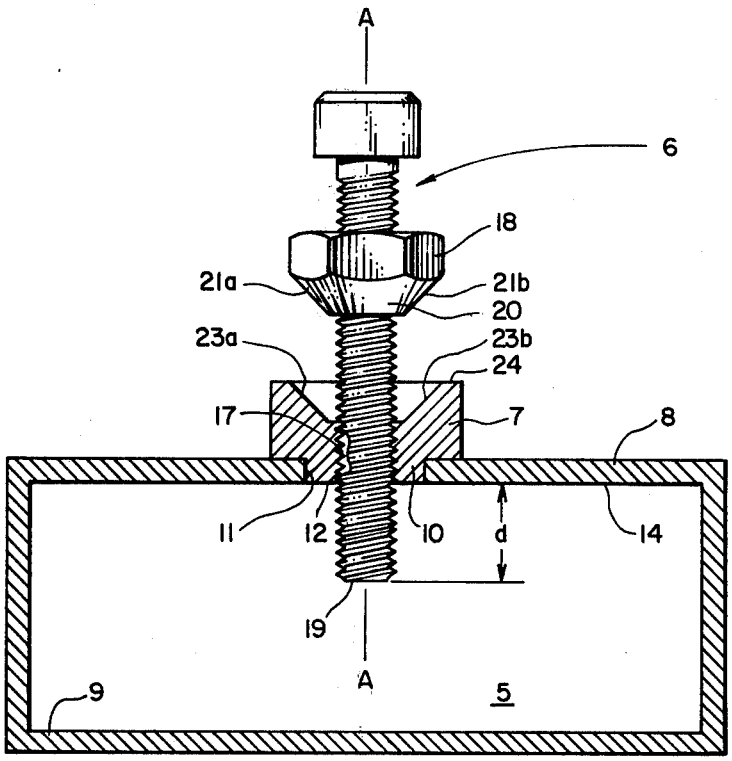
FIG. 1 is a section view of a waveguide filter including a preferred embodiment of this invention, some elements in the figure being shown in complete form for convenience of illustration.

Referring now to the section view of a waveguide filter in FIG. 1, the filter is represented by the waveguide 5 and a tuning screw 6 which is supported in a bushing 7. Since the filter itself is conventional, it is not further illustrated here. Conductive posts of an input or output element and which extend between broad walls 8 and 9 of the waveguide are omitted for simplicity of illustration. The bushing 7, which is made of an electrically conductive material such as invar, has a cylindrical projection 10 on the bottom thereof which fits snugly into an aperture 11 in the board wall 8 of the waveguide. The thickness of the projection 10 is selected so that the end 12 thereof is flush with the inside surface 14 of the waveguide wall 8. The bushing is preferably soldered into the aperture 11 to ensure positive mechanical and electrical connection to the electrically conductive waveguide wall 8. The bushing has a threaded opening 17 therethrough with an axis A—A which is orthogonal to the end 12 of the bushing and thus to the inner surface 14 of the waveguide wall 8. Alternatively, bushing 7 may be made of brass.

The tuning screw 6 is conventional, is made of an electrically conductive material such as invar, has a locknut 18 thereon, and is threaded into the opening 17 in the bushing. The circumference of the tuning screw 6, bore of the locknut 18, and opening 17 in the bushing 7 all have the same number of threads per inch formed therein. The end 19 of the screw extends into the waveguide in order to provide a variable capacitance there. The depth of the screw inside the waveguide is varied to change this capacitance and to thereby tune the filter. Lateral movement of the screw may also change the capacitance and the operating frequency of the filter.

In accordance with this invention, the nut 18 has a frustum of a cone or truncated conical section 20 projecting from the bottom thereof. The conic section is concentric with the axis A—A of the nut and is preferably dimensioned so that the opposite sides **21*a* and 21*b* thereof in a vertical section view form a right angle. Thus, the included angle between the conical faces 21*a* and 21*b* is preferably 90°. The bushing 7 has a matching countersunk hole 23 in the top surface 24 thereof for receiving the projection 20 on the locknut. The countersunk hole 23 is also coaxial with the axis A—A of the bushing and has opposite sides 23*a* and 23*b*** thereof with a 90° included angle in a vertical section view of the bushing.

In operation, the depth of the screw 6 in the waveguide is adjusted to tune the filter to approximately the desired frequency. The nut 18 is then threaded down screw 6 until the mating surfaces of the nut 18 and bushing 7 come into contact. After this initial adjustment, the nut 18 is tightened slightly against the bushing 7 to minimize all clearances and to fix the lateral position of the screw in the waveguide. Although the screw 6 may still be rotated in the nut 18 and bushing 7, it remains in an essentially upright position. After final adjustment of the screw 6 and tuning of the filter, the nut 18 is securely tightened against the bushing. This arrangement of providing matching or mating conical surfaces 21 and 23 on the locknut 18 and bushing 7 significantly reduces lateral movement of the screw 6 when it is rotated to tune the filter and when the nut is tightened securely against the bushing to lock the position of the tuning screw. It has been found that this technique eliminates the process of repeatedly retuning the filter and again locking the nut in position until the operation of the filter remains substantially the same both before and after the tuning screw is locked in position.

Figure 2:
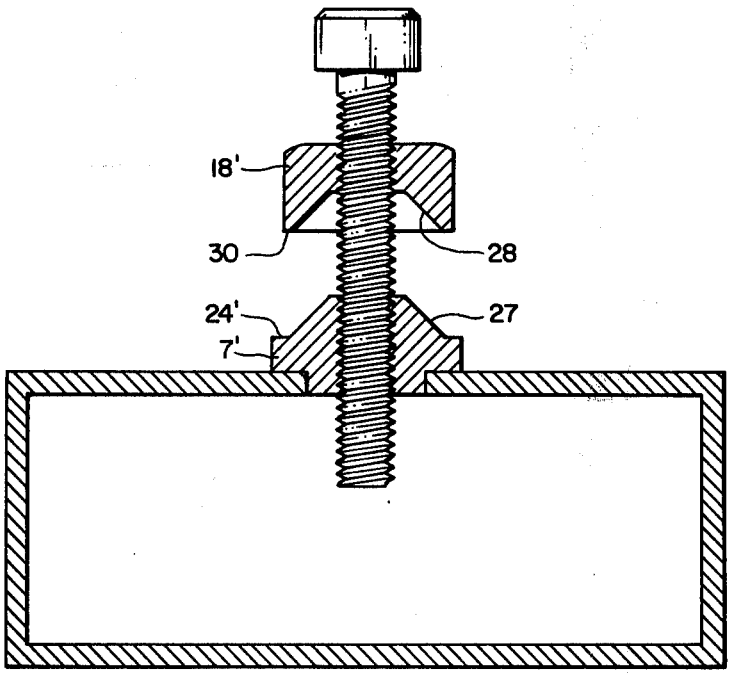
FIG. 2 is a section view of a waveguide filter including an alternate embodiment of this invention.

Although this invention is described in relation to a preferred embodiment thereof, variations and modifications thereof will occur to those skilled in the art without departing from the spirit of this invention. By way of example, the included angles between opposite sides of the conical surfaces that are defined by a vertical section through the nut and bushing may have values other that 90° as long as they are substantially the same values. Also, the opposite sides of these truncated conical surfaces defined by vertical sections through the nut and bushing may be other than straight lines as long as they are mating surfaces, e.g., the opposite sides may be curved. Further, a truncated conical surface 27 may project up from the top 24' of the bushing 7', and an associated countersunk hole 28 be formed in the bottom 30 of the nut 18', as is shown in FIG. 2. This invention may also be used on other than tuning screws and in other than waveguide devices. The scope of this invention is therefore defined by the attached claims rather than from the above detailed description of preferred embodiments thereof.

What is claimed is:

1. In a structure supporting propagation of electromagnetic waves and having a tuning screw threadably supported in an aperture in wall means thereof so as to have first and second screw portions on opposite sides of the wall means, apparatus for locking the position of the tuning screw in the structure while maintaining the axial position of the screw substantially fixed so as to prevent lateral movement thereof, comprising: a locknut being threaded onto the first portion of the screw on one side of the wall means, and a given surface on the one side of the wall means adjacent to the aperture; said locknut having a bottom surface for rotatably mating with said given surface of the wall means; said mating surfaces being tapered with respect to the axis of the screw in the aperture for maintaining the axial position of the screw substantially fixed to prevent lateral movement thereof as the locknut is threaded on the screw to securely force said mating surfaces together.

2. In a structure supporting propogation of electromagnetic waves and having a tuning screw threadably supported in an aperture in wall means thereof so as to have first and second screw portions on opposite sides of the wall means, apparatus for locking the position of the tuning screw in the structure while maintaining the axial position of the screw substantially fixed so as to prevent lateral movement thereof, comprising: a locknut being threaded onto the first portion of the screw on one side of the wall means, and a given surface on the one side of the wall means adjacent to the aperture; said locknut having a bottom surface for rotatably mating with said given surface of the wall means; one of said mating surfaces on one of said locknut and the wall means being the tapered surface of a truncated cone projecting therefrom that is coaxial with the longitudinal axes of the tuning screw in said locknut and the threaded aperture; the other one of said mating surfaces on the other one of said locknut and the wall means being the surface of a conically shaped countersunk hole formed therein coaxial with the axis of the tuning screw in the locknut and the threaded aperture; said countersunk hole receiving the truncated conically shaped projection with said surface of said locknut mating with said surface of the wall means for maintaining the axial position of the screw substantially fixed to prevent lateral movement thereof while threading the nut against the wall means to lock the position of the tuning screw.

3. Apparatus according to claim 2 wherein the structure is a waveguide device, the mating surfaces in a vertical section through the axis of the screw each being straight lines that are inclined at substantially the same angle with respect to the axis.

4. Apparatus according to claim 3 wherein the truncated conical projection is on the locknut and the countersunk hole is in the exterior of the wall means of the waveguide.

* * * * *